United States Patent [19]

Harder et al.

[11] Patent Number: 4,923,784

[45] Date of Patent: May 8, 1990

[54] PHOTOGRAPHIC ELEMENTS CONTAINING A BLEACH ACCELERATOR PRECURSOR

[75] Inventors: John W. Harder, Rochester; Stephen P. Singer, Spencerport, both of N.Y.

[73] Assignee: Eastman Kodak Company, Rochester, N.Y.

[21] Appl. No.: 270,926

[22] Filed: Nov. 14, 1988

Related U.S. Application Data

[63] Continuation-in-part of Ser. No. 124,723, Nov. 24, 1987, abandoned.

[51] Int. Cl.[5] ..... G03C 5/44; G03C 5/24; G03C 5/38; G03C 7/00

[52] U.S. Cl. ..... 430/430; 430/393; 430/429; 430/445; 430/460; 430/461; 430/487; 430/620

[58] Field of Search ..... 430/430, 393, 429, 445, 430/461, 487, 460, 620

[56] References Cited

U.S. PATENT DOCUMENTS

| | | | |
|---|---|---|---|
| 3,512,979 | 5/1970 | Nagae et al. | 96/55 |
| 3,615,513 | 10/1971 | Haist et al. | 96/61 |
| 3,893,858 | 7/1975 | Wabnitz, Jr. | 96/60 |
| 4,163,669 | 8/1979 | Kanada et al. | 96/60 |
| 4,481,290 | 11/1984 | Kishimoto et al. | 430/543 |
| 4,524,129 | 6/1985 | Kishimoto et al. | 430/393 |
| 4,695,529 | 9/1987 | Abe et al. | 430/351 |
| 4,702,999 | 10/1987 | Ohashi et al. | 430/445 |

*Primary Examiner*—Paul R. Michl
*Assistant Examiner*—Patrick A. Doody
*Attorney, Agent, or Firm*—Joshua G. Levitt

[57] ABSTRACT

Silver halide photographic elements are described containing, as a bleach accelerator precursor, a silver salt of an acid-containing, non-zwitterionic, organic thiol. The bleach accelerators are operable with a multiplicity of bleach compositions and help in reducing sensitizing dye stain.

14 Claims, No Drawings

PHOTOGRAPHIC ELEMENTS CONTAINING A BLEACH ACCELERATOR PRECURSOR

This is a continuation-in-part of U.S. application Ser. No. 124,723 filed November 24, 1987 now abandoned.

FIELD OF THE INVENTION

This invention relates to color photographic materials. In a particular aspect it relates to color photographic materials containing bleach accelerator precursors.

BACKGROUND OF THE INVENTION

A color image is formed in a color photographic element by generation of an imagewise distribution of the dye as a function of silver halide development. Typically this is formed by reaction between a coupler compound and oxidized silver halide developing agent. However, dye images can also be formed by other means such as the imagewise diffusion of dye or the imagewise destruction of dye. Regardless of the means by which the dye image is formed, it is common practice to remove the silver image formed on development and silver halide remaining in unexposed areas of the element. This is accomplished by a bleaching step in which the silver image is oxidized by a suitable oxidizing agent, commonly referred to as a bleaching agent, followed by dissolving the silver halide in a silver halide solvent, commonly referred to as a fixing agent. Alternatively, the bleaching agent and the fixing agent can be combined in a bleach-fixing solution and the silver removed in one step by the use of such a solution.

A variety of bleach compositions have been employed with silver halide materials. These include those based on, i.a., ferricyanide, dichromate, permanganate, chloride, quinone, as well as aminocarboxylic acid and persulfate oxidizing agents. Typical compositions containing such oxidizing agents for the bleaching of photographic image silver are referred to or described in U.S. Pat. Nos. 3,512,979; 3,615,513; 3,647,469; 3,689,272; 3,706,561; 3,716,362; 3,749,572; 3,772,020; 3,893,858; 4,163,669; 4,292,401; 4,293,639; 4,301,236; 4,322,493; 4,448,878; 4,458,010; 4,481,290; 4,524,129; 4,546,070; and 4,596,764.

Other descriptions of the composition and use of photographic silver bleaches are found on pages 124 and 125 of Neblette's Handbook of PHOTOGRAPHY AND REPROGRAPHY, Materials, Processes and Systems, Seventh Edition, Van Nostrand Reinhold Company; and on pages 447 to 450 of THE THEORY OF THE PHOTOGRAPHIC PROCESS, Fourth Edition, MacMillan Publishing Co., Inc., Hew York, London.

Various substituted thiols have been found to accelerate bleaching either when directly added to the bleaching solution or, if introduced via a prebath, before the bleaching step. See for example U.S. Pat. No. 3,893,858, issued July 8, 1975.

U.S. Pat. No. 4,163,669, issued August 7, 1979, suggests that there would be an advantage to incorporating the bleach accelerator directly in the photographic film but that incorporation of the free thiol would have adverse effects on the photographic properties of the film. The '669 patent suggests incorporating in a photographic element certain bleach accelerators as the salt of a heavy metal ion. Among the bleach accelerators mentioned are the organic thiols of the type described in U.S. Pat. No. 3,893,858.

While the heavy metal salts described in the '669 patent are effective with bleach compositions based on ferric EDTA, they are not as effective with other bleach compositions as would be desired. Furthermore, these compounds do not help in reducing stain attributed to residual sensitizing of dye.

Accordingly it would be desirable to have bleach accelerator precursor compounds which can be incorporated in a photographic film, which will permit the film to be used in a multiplicity of bleach and bleach-fix compositions with good results, and which will help to reduce sensitizing dye stain.

We have found compounds which can be incorporated in photographic elements as novel bleach accelerator precursors. These compounds are effective to accelerate bleaching of a variety of bleaching and bleach-fixing compositions. Moreover, they help to reduce sensitizing dye stain and do not have adverse sensitometric effects on the element.

In one embodiment our invention is a silver halide photographic element comprising a support, a silver halide emulsion layer, and a bleach accelerator precursor wherein the bleach accelerator precursor is a silver salt of an acid-containing non-zwitterionic, organic thiol, the precursor having a solubility of greater than or equal to 1 g/l silver ion in both (a) a color developing solution comprising a pH of 10, a sulfite concentration of 4.25 g/l and a bromide concentration of 1.3 g/l, and (b) a bleach solution comprising a pH of 6 and a bromide concentration of 150 g/l, when held at 23° C. for five minutes.

DETAILED DESCRIPTION OF THE INVENTION

In a preferred embodiment, the compound is solubilized by the presence of one or more carboxylic acid groups. While these compounds can contain amine groups, they should be non-basic amines so as to avoid the formation of zwitterionic moieties. The compounds are believed to be effective in reducing sensitizing dye stain by providing the silver to be bleached with a charged surface. Zwitterionic compounds, which provide a neutral surface, are less effective in reducing stain.

Preferred compounds have a relatively high solubility in both the alkaline developer composition and the acidic bleach or bleach-fix composition used during processing of the element.

As used herein, solubility is defined as grams per liter of silver ion in solution when the test compound is treated as follows: 0.4 g of the test precursor is mixed with 10 ml of the developer or bleach used in Process A, infra. The mixture is stirred for 30 seconds and held at 23° C. Five minutes after mixing a 20 ul aliquot is withdrawn, treated with cyanogeniodate to complex silver ion in solution and the silver ion present is measured by atomic adsorption spectroscopy.

Compounds useful in this invention are silver salts. However, salts of other heavy metals, such as iron, cobalt, nickel, copper, zinc, rhodium, palladium, cadmium, iridium, platinum, gold, and lead, are expected to give equivalent results.

Representative precursor compounds useful in this invention include those having the following structures:

TABLE 1

| | |
|---|---|
| 1 | $AgSC_2H_4COOH$ |
| 2 | $AgSCH_2COOH$ |
| 3 | $AgSC_2H_4OC_2H_4COOH$ |
| 4 | $AgSC_2H_4SC_2H_4COOH$ |
| 5 | 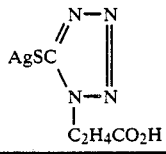 |

By employing such a bleach accelerator precursor in a photographic element, reductions in residual silver levels—that is silver levels still present following bleaching—can be achieved. With reduced residual silver, contrast is decreased and image quality and color saturation are improved. Additionally the infrared density of the photographic element contributed by the residual silver can be reduced, which is advantageous when other infrared absorbing features, such as sound tracks and control markings, form a part of the photographic element. As an alternative to lowering residual silver levels an advantage can be realized in shortening the time of the bleaching step, if desired.

The bleach accelerator precursors of the present invention are advantageously employed with photographic elements which contain dye adsorbed to developable silver halide surfaces. They are particularly advantageous with photographic elements containing high levels of sensitizing dye, such as spectrally sensitized high aspect ratio tabular grain emulsions, as described in *Research Disclosure*, January 1983, Item 22543. *Research Disclosure* is published by Emsworth Studios Inc., New York, N. Y.

A major source of color stains in color photographic materials is sensitizing dye retained in the material after processing. By virtue of the solubility in high-pH color developer solutions, the compounds of this invention help to remove such dye by preventing its readsorption onto developed silver, thereby allowing more of it to wash out of the material.

One or more bleach accelerator precursors of the invention can be located in the photographic element at any convenient location capable of permitting diffusion of the released active fragment to a silver containing emulsion layer during bleaching. Thus the compound can be incorporated directly in the silver halide emulsion layer from which silver is to be bleached, or alternatively in any other bleach solution permeable layer of the photographic element on either side of the support, particularly any layer adjacent the emulsion layer from which silver is to be bleached. The bleaching of silver from the usually lowermost red-sensitized emulsion layer in a color photographic element can advantageously be enhanced by incorporating the accelerator precursor in an underlying antihalation layer.

The bleach accelerator precursor compounds of the present invention can be incorporated in the photographic element by a variety of techniques. Especially preferred techniques include homogenizing or ball milling a slurry of the compound in the presence of a surfactant to form finely divided particles, as disclosed in Swank et al U.S. Pat. No. 4,006,025, milling a mixture of molten compound and a molten or liquid dispersing agent, as described in British Patent No. 1,151,590, or mechanically dispersing the compound, as described in Belgian Patent No. 852,138. Ultrasound can be employed to dissolve the compound prior to its incorporation in the photographic coating composition, as illustrated by Owen et al. U.S. Pat. No. 3,485,634 and Salminen U.S. Pat. No. 3,551,157. Alternatively, the compound can be dispersed directly in a hydrophilic colloid such as gelatin; or the compound can be loaded into a latex and dispersed, as illustrated by Chen *Research Disclosure*, Vol. 159 July 1977, Item 15930. Exemplary apparatus and procedures for introducing and blending the bleach accelerator precursor according to this invention are illustrated by Johnson et al U.S. Pat. Nos. 3,425,835; 3,570,818; 3,773,302 and 3,850,643; McCrossen et al U.S. Pat. No. 3,342,605, Collins et al U.S. Pat. No. 2,912,343 and Terwilliger et al U.S. Pat. Nos. 3,827,888 and 3,888,465.

Our bleach accelerator precursors are incorporated in a photographic element, such as an otherwise conventional color photographic element, preferably at levels in the range of from 0.01 to 10 $g/m^2$, with levels of from 0.05 to 0.15 $g/m^2$ being optimum for ordinarily encountered silver levels. For photographic elements having elevated silver levels still higher levels of the compounds may be desirable.

In its preferred application this invention is directed to bleaching silver from photographic elements capable of producing multicolor dye images. Such photographic elements are typically comprised of a support having coated thereon a plurality of color forming layer units. The color forming layer units include at least one blue recording yellow dye image forming layer unit, at least one green recording magenta dye image forming layer unit, and at least one red recording cyan dye image forming layer unit. Each color forming layer unit includes at least one silver halide emulsion layer. A dye image providing material such as a coupler can be located in the emulsion layer, in an adjacent layer, or introduced during development. The emulsion layer or layers in the blue recording layer unit can rely on native sensitivity to blue light or contain adsorbed to the silver halide grains of the emulsion a dye capable of absorbing blue light, i.e. a blue sensitizing dye. Sensitizing dyes capable of absorbing green and red light are adsorbed to silver halide grain surfaces in the emulsion layers of the green and red recording color forming layer units, respectively.

To prevent color contamination of adjacent color forming layer units, oxidized development product scavengers can be incorporated at any location in the color forming layer units or an interlayer separating the adjacent color forming layer units. Useful scavengers include alkyl substituted aminophenols and hydroquinones, as disclosed by Weissberger et al U.S. Pat. No. 2,336,327 and Yutzy et al U.S. Pat. No. 2,937,086, sulfoalkyl substituted hydroquinones, as illustrated by Thirtle et al U.S. Pat. No. 2,701,197, and sulfonamido substituted phenols, as illustrated by Erikson et al U.S. Pat. No. 4,205,987.

Any conventional silver halide emulsion containing a dye adsorbed to the surface of the silver halide grains can be employed. For color print applications silver chloride, silver bromide and silver chlorobromide emulsions are particularly contemplated, while for camera speed photography silver bromoiodide emulsions are preferred. The silver halide emulsions can be direct positive emulsions, such as internal latent image desensitized emulsions, but are in most applications negative-working. Illustrative silver halide emulsion types and preparations are disclosed in *Research Disclosure*, Vol. 176, December 1978, Item 17643, Paragraph I. Particularly preferred silver halide emulsions are high aspect ratio tabular grain emulsions, such as those described in *Research Disclosure*, Item 22534, cited above.

Illustrative dyes usefully adsorbed to silver halide grain surfaces are those dyes commonly employed to alter the native sensitivity, extend the spectral sensitivity, or to perform both functions in silver halide emulsions, often collectively referred to as spectral sensitizing dyes. Such adsorbed dyes can be chosen from a variety of classes, including the polymethine dye class, which includes the cyanines, merocyanines, complex cyanines and merocyanines, oxonols, hemioxonols, styryls, merostyryls and streptocyanines.

For a more detailed discussion of the use of spectral sensitizing dyes in color photographic materials, reference is made to *Research Disclosure*, December 1978, Item 17643, Paragraph IV.

Although it has been specifically recognized that dyes adsorbed to silver halide grain surfaces can inhibit the bleaching of silver developed in photographic materials, it is believed that similar inhibition of bleaching can be imparted by other adsorbed addenda. Therefore, the advantages of the disclosed invention are attained with bleaching from photographic elements of silver produced by development of silver halide having adsorbed addenda other than dyes.

The photographic elements can be comprised of any conventional photographic support. Typical photographic supports include polymer film, wood fiber—e.g., paper, metallic sheet and foil, glass and ceramic supporting elements provided with one or more subbing layers to enhance the adhesive, antistatic, dimensional, abrasive, hardness, frictional, antihaltion, or other properties of the support surfaces. Typical useful supports are further disclosed in *Research Disclosure*, Item 17643, December 1978, Paragraph XVII.

In addition to features described above the photographic element can, of course, contain other conventional features known in the art, which can be illustrated by reference to Research Disclosure, Item 17643, cited above. For example, the silver halide emulsions can be chemically sensitized, as described in Paragraph III; contain brighteners, as described in Paragraph V; contain antifoggants and stabilizers, as described in Paragraph VI; absorbing and scattering materials, as described in Paragraph III; the emulsion and other layers can contain vehicles, as described in Paragraph IX; the hydrophilic colloid and other hydrophilic colloid layers can contain hardeners, as described in Paragraph X; the layers can contain coating aids, as described in Paragraph XI; the layers can contain plasicizers and lubricants, as described in Paragraph XII; and the layers, particularly the layers farthest from the support, can contain matting agents, as described in Paragraph XVI. This exemplary listing of addenda and features is not intended to restrict or imply the absence of other conventional photographic features compatible with the practice of the invention.

Exposed photographic elements of the invention can be processed by any conventional technique of producing a dye image, whereafter the concurrently developed silver image is removed by bleaching or bleach-fixing. Residual, undeveloped silver halide can be removed in a separate fixing step or concurrently with bleaching. A separate pH lowering solution, referred to as a stop bath, may be employed to terminate development prior to bleaching. A stabilizer bath can be employed prior to drying. Conventional techniques for processing are illustrated by *Research Disclosure*, Item 17643, Paragraph XIX.

Although the invention has been described in terms of employing one or more compounds to enhance bleaching, it is appreciated that other, compatible compounds for enhancing bleaching can, if desired, be employed in combination. Such other compounds may be present in the photographic element or a processing solution.

The salts according to this invention can be prepared by methods well known in the organic compound synthesis art.

The starting thiol materials are commercially available or can be prepared from commercially available material by known procedures. After reaction of the thiol with the appropriate water-soluble salt, such as silver nitrate, the resulting compound is purified to remove reaction products that might have an adverse effect on the sensitometric properties of the silver halide emulsion.

Preparation of Precursor 1

$$\underset{(a)}{AgNO_3} + \underset{(b)}{HSC_2H_4COOH} \xrightarrow{H_2O} AgSC_2H_4COOH$$

30 g of 3-mercaptoproprionic acid (b) was dissolved in 1 l of water and treated with 56 ml of 5 molar solution of silver nitrate (a). A white solid formed immediately and was stirred at room temperature for 2 hours until it was mixed thoroughly. The reaction became exothermic after addition of the silver nitrate was completed and a brown gas ($HNO_3$) evolved. The white solid was collected, washed with 2 l of water and dried in a vacuum oven at room temperature.

Yield: 45 g (82%)

| Analysis | Found | Theory |
|---|---|---|
| N | 0.3 | 0 |
| C | 12.3 | 16.9 |
| H | 1.5 | 2.4 |
| S | 10.9 | 15.1 |

Other compounds according to the invention can be prepared analogously.

EXAMPLES

The following examples further illustrate this invention. In these examples, the bleach accelerator precursors of the invention and comparison compounds have the structures shown below. Where available, solubilities measured as described above, are provided.

| COMPOUND | STRUCTURE | SOLUBILITY g Ag/L DEVELOPER | BLEACH |
|---|---|---|---|
| Comparison Compound A | $AgSCH_2C(NH_3^+)(CO_2^-)$ | 12.5 | 1.9 |
| Comparison Compound B | $AgSC_4H_9$-n | 0.02 | 0.02 |
| Comparison Compound C | 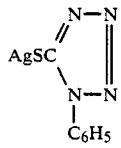 | 0.3 | 0.1 |
| Inventive Compound 1 | $AgSC_2H_4COOH$ | 7.5 | 1.7 |
| Inventive Compound 2 | $AgSCH_2COOH$ | Not Measured | |
| Inventive Compound 3 | $AgSC_2H_4OC_2H_4COOH$ | 19.2 | 17.0 |
| Inventive Compound 4 | $AgSC_2H_4SC_2H_4COOH$ | Not Measured | |
| Inventive Compound 5 | 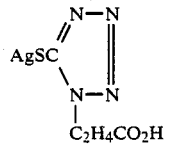 | 14.4 | 8.3 |

EXAMPLE 1—Bleach Performance

A first, control, photographic element was prepared having the following structure, wherein all numbers in parentheses represent coverage in g/m$^2$:

| | |
|---|---|
| Layer 3 | Gelatin (5.3) |
| Layer 2 | Gelatin (3.7) - Spectrally red sensitized silver halide [silver coverage (1.6)]<br>Spectral sensitizing dye A (.30)<br>Spectral sensitizing dye B (.52)<br>Cyan dye forming coupler (.84) |
| Layer 1 | Gelatin (2.6) - Grey colloidal silver (.32)<br>Transparent Film Support |

Sensitizing Dye A

Anhydro-5,6-dichloro-1-ethyl-3-(3-sulfobutyl)-3'-(3-sulfopropyl)-4',5'-benzobenzimidazolothiacarbocyanine hydroxide

Sensitizing Dye B

Anhydro-5,5'-dichloro-9-ethyl-3,3'-bis(3-sulfopropyl) thiacarbocyanine hydroxide

Cyan Dye Forming Coupler:

1-Hydroxy-2-[4-(2,4-di-tert-pentylphenoxy)butyl]-naphthamide.

Additional photographic elements were prepared, which were identical to the control described above, except that the respective bleach accelerators identified in Table 2 were introduced into Layer 1 at a coverage of 0.1 g/m$^2$. They were incorporated in the coating composition via a dispersion method exemplified by the specific procedure for incorporating Precursor 1 as follows:

A mixture consisting of 6 g of Precursor 1, 16 ml of a 6.7% TX-200 surfactant solution (available from ROHM & HAAS Company, Philadelphia), 130 g distilled water and 250 ml of 2 mm ceramic ZrO beads was shaken for 3 hours on a SWECO milling machine (SWECO, Inc., Florence, Kentucky). Following the subsequent addition of 48 g of a 12.5% aqueous gelatin solution and the removal of the ceramic beads by filtration through a coarse silk bag, a milky-white dispersion was obtained.

Separate strips of each of the photographic elements described above were uniformly exposed to white light and then processed in conventional color processes including a bleach (Process A) and a bleach-fix (Process B), respectively.

| Process A: | |
|---|---|
| Color development | 3 min 15 sec |
| Bleach | 1 min/4 min |
| Wash | 1 min |
| Fix | 4 min |
| Drying | |

Composition of Processing Solutions

| | |
|---|---|
| Color developer | |
| Water | 800 ml |
| Potassium carbonate | 37.5 g |
| Sodium sulfite (dessic.) | 4.25 g |
| Potassium iodide | 1.2 g |
| Sodium bromide | 1.3 g |
| Hydroxylamine sulfate | 2.0 g |
| Diaminopropanol tetra acetic acid | 2.5 g |
| 4-Amino-3-methyl-N-ethyl-N-hydroxyethylaniline sulfate | 4.75 g |
| Potassium hydroxide (45% soln.) | 0.65 ml |
| Water to total of | 1 liter |
| pH 10.0 | |
| Bleach | |
| Water | 600 ml |
| Ammonium bromide | 150 g |
| FeEDTA | 175 ml |
| Glacial acetic acid | 10.5 ml |
| Potassium nitrate | 41.2 g |
| Water to total of | 1 liter |

-continued

| | |
|---|---|
| pH 6.0 | |
| Fix | |
| Water | 800 ml |
| Ammonium thiosulfate (58% soln.) | 162 ml |
| EDTA, disodium salt | 1.25 g |
| Sodium bisulfite (anhydr.) | 12.4 g |
| Sodium hydroxide | 2.4 g |
| Water to total of | 1 liter |
| pH 6.5 | |
| Process B: | |
| Color development | 3 min 15 sec |
| Bleach-fix | 1 min/4 min |
| Wash | 4 min |
| Drying | |

Composition of Processing Solutions

| | |
|---|---|
| Color Developer | |
| Water | 800 ml |
| Potassium carbonate | 37.5 g |
| Sodium sulite (dessic.) | 4.25 g |
| Potassium iodide | 1.2 g |
| Sodium bromide | 1.3 g |
| Hydroxylamine sulfate | 2.0 g |
| Diaminopropanol tetraacetic acid | 2.5 g |
| 4-Amino-3-methyl-N-ethyl-N-hydroxyethylaniline sulfate | 4.75 g |
| Potassium hydroxide (45% soln.) | 0.65 ml |
| Water to total of | 1 liter |
| pH 10.0 | |
| Bleach fix | |
| Ammonium thiosulfate | 104 g |
| Sodium bisulfite | 13 g |
| Ammonium FeEDTA (.18 M) | 65.6 g |
| EDTA | 6.56 g |
| Ammonium hydroxide (28% soln.) | 27.9 ml |
| Water to total of | 1 liter |
| pH 6.8 | |

The amount of silver in the processed element was measured by X-ray fluorescence. The amount is reported in Table 2, in g/m$^2$, for 1 and 4 minutes bleach. The data in Table 2 demonstrate the superior effectiveness of the bleach accelerator precursors of the invention in removing silver from color developed photographic elements treated in either a bleach or a bleach-fix process.

TABLE 2

| | | (Process A) Silver remaining after | | (Process B) Silver remaining after | |
|---|---|---|---|---|---|
| Element | Bleach Accelerator Precursor | 1 min. bleaching (g Ag/m$^2$) | 4 min. | 1 min. bleach-fixing (g Ag/m2) | 4 min. |
| 1 | — | 10.7 | 7.0 | — | 11.0 |
| 2 | A | 20.3 | 7.2 | 6.1 | 1.2 |
| 3 | B | 38.4 | 14.3 | 82.3 | 74.6 |
| 4 | C | 30.1 | 15.5 | 4.5 | 0.2 |
| 5 | 1 | 4.0 | 0 | 0.6 | 0 |
| 6 | 4 | 10.4 | 8.0 | 4.7 | 0 |

EXAMPLE 2—Dye Stain Performance

Photographic elements were prepared as described in Example 1, sensitometric exposed through a graduated density test object and then processed by Procedure A described in Example 1. To evaluate stain attributed to residual sensitizing dye, maximum density in each of the blue, green and red regions of the spectrum were measured using blue, green and red filters, respectively (Status M filter). From the resulting densities ($D_B$, $D_G$ and $D_R$) there is then calculated the ratio of the blue or green density, which is unwanted, to red density, which is wanted. A lower ratio, indicates that there is less dye stain and hence improved color purity and better color separation. The results are shown in Table 3.

TABLE 3

| Element | Bleach Accelerator | DB/DR | DG/DR |
|---|---|---|---|
| 7 | — | .32 | .33 |
| 8 | A | .28 | .27 |
| 9 | B | .30 | .29 |
| 10 | C | .36 | .35 |
| 11 | 1 | .12 | .15 |
| 12 | 4 | .17 | .20 |
| 13 | 5 | .12 | .16 |

The data in Table 3 demonstrate the superior effectiveness of the bleach accelerator precursors of this invention in removing residual stain from processed color photographic film.

The invention has been described in detail with particular reference to preferred embodiments thereof, but it will be understood that variations and modifications can be effected within the spirit and scope of the invention.

What is claimed is:

1. A color photographic element comprising a support, a silver halide emulsion layer and, as a bleach accelerator precursor, a silver metal salt of an acid-containing non-zwitterionic organic thiol, the precursor having a solubility of greater than or equal to 1 g/l silver ion in both (a) a color developing solution comprising a pH of 10, a sulfite concentration of 4.25 g/l and a bromide concentration of 1.3 g/l, and (b) a bleach solution comprising a pH of 6 and a bromide concentration of 150 g/l, when held at 23° C. for five minutes.

2. An element of claim 1 wherein the thiol is an alkyl thiol.

3. An element of claim 1 wherein the thiol has a structure selected from:

$AgSC_2H_4COOH$ $AgSCH_2COOH$ $AgSC_2H_4OC_2H_4COOH$ $AgSC_2H_4SC_2H_4COOH$.

4. An element of claim 1 wherein the thiol has a structure selected from:

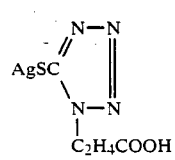

5. An element of claim 1 wherein the bleach accelerator precursor is contained in a photosensitive silver halide emulsion layer.

6. An element of claim 1 wherein the bleach accelerator precursor is contained in a radiation insensitive layer.

7. An element of claim 6 wherein the bleach accelerator precursor is contained in a radiation insensitive layer between the support and the lowermost radiation sensitive layer.

8. An element of claim 1 wherein the bleach accelerator precursor is present in the element at a concentration of 0.01 to 10 g/m$^2$.

9. An element of claim 1 wherein the bleach accelerator precursor is present in the element at a concentration of 0.05 to 0.15 g/m$^2$.

10. An element of claim 1 further containing a dye-forming coupler.

11. In a process of bleaching silver from an exposed and developed photographic material by contacting the material with a bleaching agent, the improvement wherein there is present in the photographic material a bleach accelerator precursor which is a heavy metal salt of an acid-containing, non-zwitterionic organic thiol, the precursor having a solubility of greater than or equal to 1 g/l silver ion in both (a) a color developing solution comprising a pH of 10, a sulfite concentration of 4.25 g/l and a bromide concentration of 1.3 g/l, and (b) a bleach solution comprising a pH of 6 and a bromide concentration of 150 g/l, when held at 23° C. for five minutes.

12. A process of claim 11, wherein the bleaching agent is a ferric ethylene diamine tetraacetic acid bleaching agent.

13. A process of claim 11, wherein the bleach accelerator precursor is present as a ball milled dispersion.

14. A photographic element comprising a support, a spectrally sensitized silver halide emulsion layer and, as a bleach accelerator precursor, a compound having one of the structures:

$AgSCH_2COOH$ and $AgSC_2H_4COOH$.

* * * * *